US009164448B2

(12) United States Patent
Kanematsu et al.

(10) Patent No.: US 9,164,448 B2
(45) Date of Patent: Oct. 20, 2015

(54) FIXING DEVICE AND IMAGE FORMING APPARATUS

(71) Applicant: KYOCERA Document Solutions Inc., Osaka (JP)

(72) Inventors: Yoshiharu Kanematsu, Osaka (JP); Yoshihiro Yamagishi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/628,489

(22) Filed: Feb. 23, 2015

(65) Prior Publication Data

US 2015/0248088 A1 Sep. 3, 2015

(30) Foreign Application Priority Data

Feb. 28, 2014 (JP) ..... 2014-037657

(51) Int. Cl.
*G03G 15/20* (2006.01)

(52) U.S. Cl.
CPC ..... *G03G 15/2053* (2013.01)

(58) Field of Classification Search
USPC ..... 399/67–70, 107, 110, 122, 320, 328, 399/329
See application file for complete search history.

(56) References Cited

U.S. PATENT DOCUMENTS

| | | | | |
|---|---|---|---|---|
| 5,778,294 | A * | 7/1998 | Hiraoka et al. | 399/329 |
| 7,020,423 | B2 * | 3/2006 | Ono et al. | 399/329 |
| 7,502,585 | B2 * | 3/2009 | Uehara et al. | 399/329 |
| 8,351,807 | B2 * | 1/2013 | Seki | 399/45 |

FOREIGN PATENT DOCUMENTS

JP 2003-302852 10/2003

* cited by examiner

*Primary Examiner* — Hoan Tran
(74) *Attorney, Agent, or Firm* — Wenderoth, Lind & Ponack, L.L.P.

(57) ABSTRACT

A fixing device according to one aspect of the present disclosure includes a fixing belt, a pressure member, a heating member, a pressing member, and a heat source. The fixing belt is rotational. The pressure member is rotational and is brought into press-contact with the fixing belt to form a fixing nip. The heating member is rotational and is disposed to interpose the fixing belt between the heating member and the pressure member. The pressing member is disposed to interpose the fixing belt between the pressing member and the pressure member and presses the fixing belt toward the pressure member side. The heat source is disposed radially inside the fixing belt and radially outside the heating member. Radiant heat radiated from the heat source directly reaches the fixing belt, the heating member, and the pressing member.

8 Claims, 7 Drawing Sheets

FIXING DEVICE AND IMAGE FORMING APPARATUS

CROSS-REFERENCE TO RELATED APPLICATION

This application is based upon and claims the benefit of priority from Japanese Patent Application No. 2014-037657 filed on Feb. 28, 2014, the entire contents of which are incorporated herein by reference.

BACKGROUND

The technology of the present disclosure relates to a fixing device that fixes a toner image on a recording medium and an image forming apparatus provided with the fixing device.

Conventionally, electrophotographic image forming apparatuses such as a copy machine and a printer are provided with fixing devices that fix a toner image on a recording medium such as a sheet. Among such fixing devices, there is a fixing device employing a belt fixing system. In the belt fixing system, a fixing belt and a pressure member (for example, a pressure roller) are brought into press-contact with each other to form a fixing nip.

As an image forming apparatus of the belt fixing system, for example, there is disclosed a fixing device provided with a fixing belt rotatably provided, a pressure member brought into press-contact with the fixing belt to form a fixing nip, a heating member disposed to interpose the fixing belt between the pressure member and the heating member, a pressing member disposed to interpose the fixing belt between the pressure member and the pressing member, and a heating source (for example, a halogen lamp) disposed radially inside the heating member.

SUMMARY

A fixing device according to one aspect of the present disclosure includes a fixing belt, a pressure member, a heating member, a pressing member, and a heat source. The fixing belt is rotatably. The pressure member is rotational and is brought into press-contact with the fixing belt to form a fixing nip. The heating member is rotational and is disposed to interpose the fixing belt between the heating member and the pressure member. The pressing member is disposed to interpose the fixing belt between the pressing member and the pressure member and presses the fixing belt toward the pressure member side. The heat source is disposed radially inside the fixing belt and radially outside the heating member. Radiant heat radiated from the heat source directly reaches the fixing belt, the heating member, and the pressing member.

An image forming apparatuses according to one aspect of the present disclosure is provided with the aforementioned fixing device.

DETAILED DESCRIPTION

First Embodiment

Figure 1:
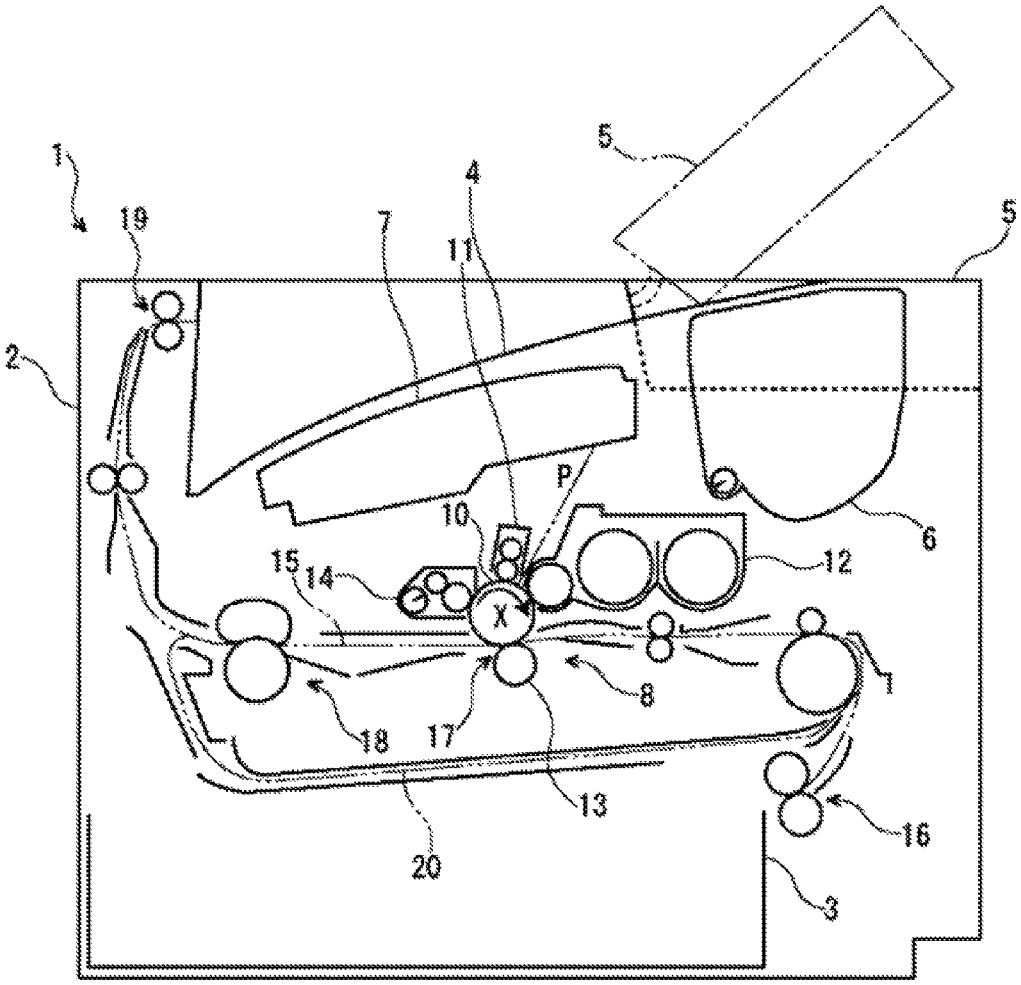
FIG. 1 is a schematic view illustrating an outline of a printer according to a first embodiment.

Firstly, an entire configuration of a printer 1 (an image forming apparatus) will be described with reference to FIG. 1.

The printer 1 is provided with a box-shaped printer body 2, and a sheet feeding cassette 3 is accommodated in a lower portion of the printer body 2 to accommodate sheets (recording medium), and a sheet discharge tray 4 is provided on an upper surface of the printer body 2. On the upper surface of the printer body 2, an upper cover 5 is mounted at a lateral side of the sheet discharge tray 4 so as to be openable and closable, and a toner container 6 is accommodated below the upper cover 5.

In an upper portion of the printer body 2, an exposure unit 7 including a laser scanning unit (LSU) is disposed below the sheet discharge tray 4, and an image forming unit 8 is provided below the exposure unit 7. A photosensitive drum 10 serving as an image carrying member is rotatably provided in the image forming unit 8, and a charger 11, a developer 12, a transfer roller 13, and a cleaning device 14 are disposed around the photosensitive drum 10 along a rotation direction (referring to an arrow X of FIG. 1) of the photosensitive drum 10.

The printer body 2 is provided therein with a sheet conveyance path 15. A sheet feeding unit 16 is provided at an upstream end of the conveyance path 15, a transfer unit 17 including the photosensitive drum 10 and the transfer roller 13 is provided at a midstream portion of the conveyance path 15, a fixing device 18 is provided at a downstream portion of the conveyance path 15, and a sheet discharge unit 19 is provided at a downstream end of the conveyance path 15. An inversion path 20 for duplex printing is formed below the conveyance path 15.

Next, an image forming operation of the printer 1 having such a configuration will be described.

When the printer 1 is powered on, various parameters are initialized, and initial setting such as temperature setting of the fixing device 18 is performed. Then, when image data is input from a computer and the like connected to the printer 1 and a print start instruction is made, an image forming operation is performed as follows.

First, after the surface of the photosensitive drum 10 is charged by the charger 11, exposure corresponding to the image data is performed for the photosensitive drum 10 by laser light (referring to a two-dot chain line P of FIG. 1) from the exposure unit 7, so that an electrostatic latent image is formed on the surface of the photosensitive drum 10. Then, the developer 12 develops the electrostatic latent image to a toner image by a toner.

On the other hand, a sheet taken out from the sheet feeding cassette 3 by the sheet feeding unit 16 is conveyed to the transfer unit 17 at the same timing as that of the aforementioned image forming operation, so that the toner image on the photosensitive drum 10 is transferred to the sheet in the transfer unit 17. The sheet with the transferred toner image is conveyed to a downstream side in the conveyance path 15 and enters into the fixing device 18, so that the toner image is fixed to the sheet in the fixing device 18. The sheet with the fixed toner image is discharged to the sheet discharge tray 4 from the sheet discharge unit 19. In addition, a toner remaining on the photosensitive drum 10 is collected by the cleaning device 14.

Figure 2:
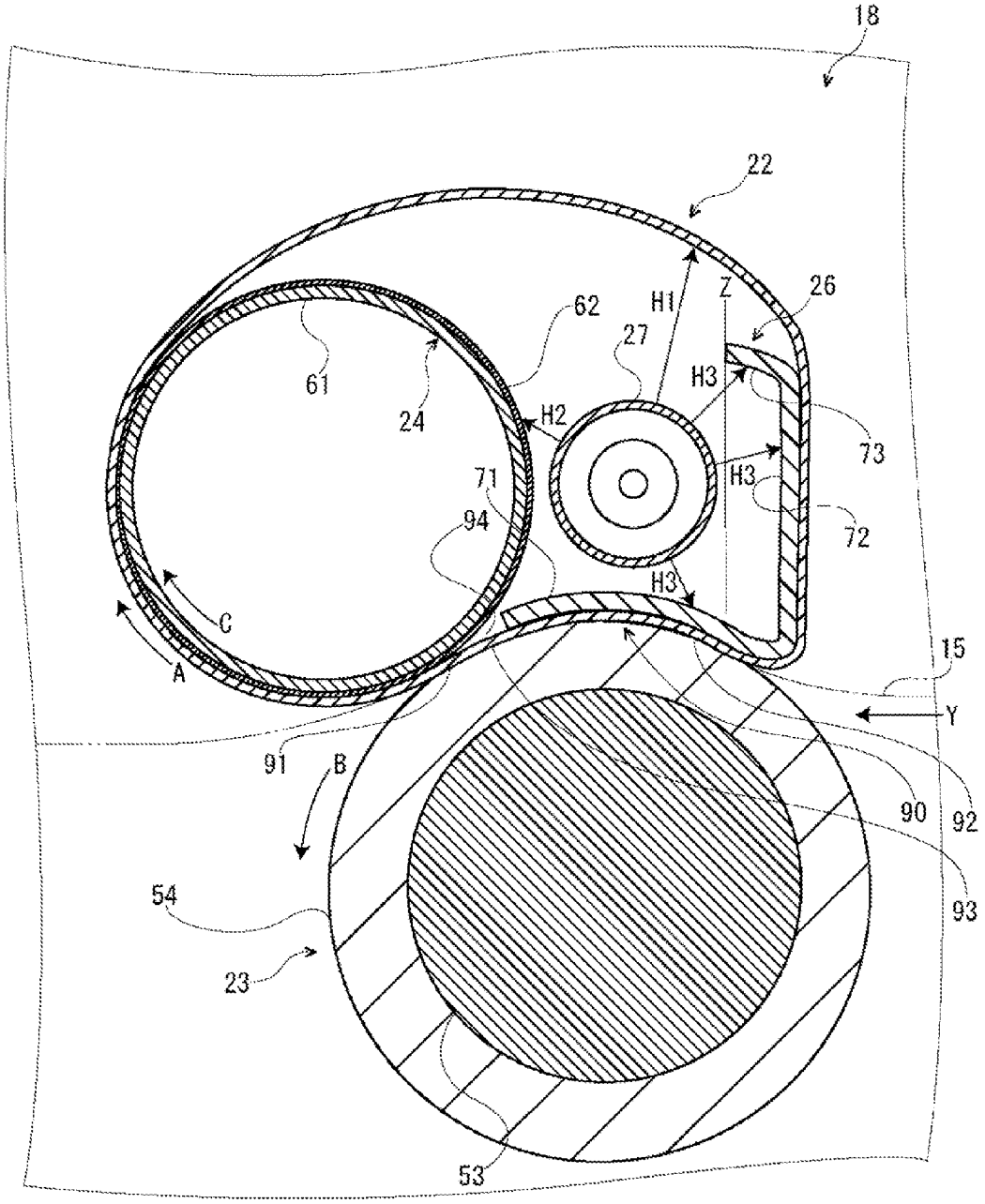
FIG. 2 is a sectional view illustrating a fixing device according to a first embodiment.

Next, the fixing device 18 will be described in detail with reference to FIG. 2 and FIG. 3. Hereinafter, for the purpose of convenience, a paper surface in FIG. 2 is set as a front side of the fixing device 18. An arrow Y of FIG. 2 indicates a sheet conveyance direction. An arrow Fr appropriately illustrated in each drawing indicates the front side of the fixing device 18.

Figure 3:
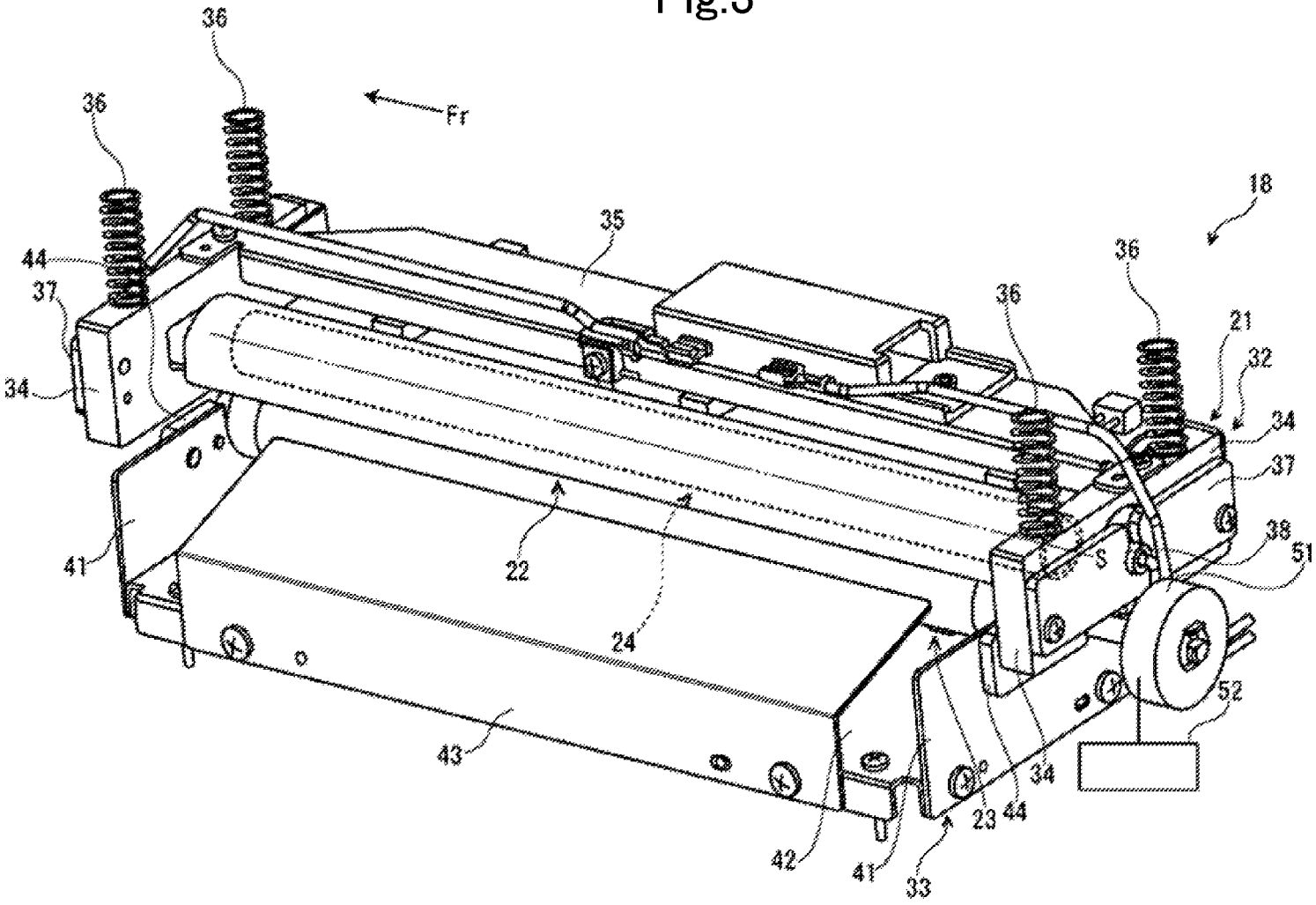
FIG. 3 is a perspective view illustrating a fixing device according to a first embodiment.

As illustrated in FIG. 2 and FIG. 3, the fixing device 18 includes a fixing frame 21 (not illustrated in FIG. 2), a fixing belt 22 provided in an upper portion of the fixing frame 21, a pressure roller 23 (a pressure member) provided in a lower portion of the fixing frame 21, a heating roller 24 (a heating member) disposed radially inside the fixing belt 22, a pressing member 26 disposed radially inside the fixing belt 22 and at the right side of (radially outside) the heating roller 24, and a heater 27 (a heat source) disposed radially inside the fixing belt 22 and at the right side of (radially outside) the heating roller 24 similarly to the pressing member 26.

As illustrated in FIG. 3, the fixing frame 21 includes an upper frame 32 and a lower frame 33. The upper frame 32 is provided ascendably/descendably with respect to the lower frame 33.

The upper frame 32 of the fixing frame 21 includes a pair of front and rear upper base plates 34 extending in the vertical direction. The upper end portions of the pair of front and rear upper base plates 34 are connected to each other by a connection frame 35. Lower end portions of a pair of right and left coil springs 36 (urging members) abut the upper surface of each upper base plate 34. The coil springs 36 urge the upper frame 32 downward (to the lower frame 33 side). A support piece 37 is fixed to an outer surface of each upper base plate 34. A mounting groove 38 is recessed at a center portion in the right and left direction of the support piece 37.

The lower frame 33 of the fixing frame 21 includes a pair of front and rear lower base plates 41 extending in the vertical direction. The lower portions of the pair of front and rear lower base plates 41 are connected to each other by a connection plate 42. Guide plates 43 are fixed to both right and left edge portions of the connection plate 42. Each guide plate 43 is bent inward in the right and left direction and extends to the lateral side of the pressure roller 23. A bearing plate 44 is fixed to an outer surface of each lower base plate 41.

The fixing belt 22 has a cylindrical shape long in the front and rear direction. That is, in the present embodiment, the front and rear direction is the axial direction of the fixing belt 22. The fixing belt 22 has flexibility. The fixing belt 22 is urged downward (to the pressure roller 23 side) by the aforementioned coil springs 36.

As illustrated in FIG. 2, the fixing belt 22 is laid over the heating roller 24 and the pressing member 26 in the state in which an upper portion of the fixing belt 22 is loosened. The fixing belt 22 is rotatably provided. An arrow A of FIG. 2 indicates the rotation direction of the fixing belt 22.

The fixing belt 22, for example, has a diameter of 24 mm. The fixing belt 22, for example, includes a base layer, an elastic layer circumferentially provided on the base layer, and a release layer for covering the elastic layer. The base layer of the fixing belt 22, for example, is made of PI (polyimide) having a thickness of 50 μm. The elastic layer of the fixing belt 22, for example, is made of silicone rubber having a thickness of 200 μm. The release layer of the fixing belt 22, for example, is made of PFA coating having a thickness of 10 μm. In addition, in each diagram, the layers (the base layer, the elastic layer, and the release layer) of the fixing belt 22 are not particularly distinguished from one another.

The pressure roller 23 has a columnar shape long in the front and rear direction. As illustrated in FIG. 3 and the like, the pressure roller 23 is disposed at the lower side (radially outside) of the fixing belt 22. Both front and rear end portions of the pressure roller 23 are pivotally supported to each bearing plate 44 of the lower frame 33. In this way, the pressure roller 23 is rotatably supported to the lower frame 33. A transmission gear 51 is fixed to a rear end portion of the pressure roller 23. The transmission gear 51 is connected to a driving source 52 such as a motor. With such a configuration, the driving source 52 is connected to the pressure roller 23 via the transmission gear 51, so that the rotation of the driving source 52 is transferred to the pressure roller 23 via the transmission gear 51 and thus the pressure roller 23 is rotated. That is, the pressure roller 23 is configured to be rotated by the driving source 52.

As illustrated in FIG. 2, the pressure roller 23, for example, includes a columnar (solid) core 53 and an elastic layer 54 circumferentially provided on the core 53. The core 53 of the pressure roller 23, for example, is made of metal such as aluminum. The elastic layer 54 of the pressure roller 23, for example, is made of foamed silicone rubber having a diameter of 20 mm, a thickness of 5 mm, and hardness of 44°. The elastic layer 54 of the pressure roller 23 has a coefficient of friction higher than that of the core 53 of the pressure roller 23.

The heating roller 24 has a cylindrical shape long in the front and rear direction. The heating roller 24 is disposed to interpose the fixing belt 22 between the heating roller 24 and the pressure roller 23. The heating roller 24, for example, includes a base layer 61 and a coating layer 62 for covering the base layer 61. The base layer 61 of the heating roller 24, for example, is made of aluminum having a diameter of 15 mm and a thickness of 1 mm. The coating layer 62 of the heating roller 24, for example, is made of a fluorine resin, PI (polyimide), ceramic-based material and the like, and has a coefficient of friction higher than that of the base layer 61 of the heating roller 24. The coating layer 62 of the heating roller 24 contacts with an inner peripheral surface of the fixing belt 22.

Both front and rear end portions of the heating roller 24 are pivotally supported to the support pieces 37 of the upper frame 32 (referring to FIG. 3) via bearings (not illustrated). In this way, the heating roller 24 is supported to the upper frame 32 so as to rotate about a rotating shaft S (referring to FIG. 3) extending in the front and rear direction. That is, in the present embodiment, the front and rear direction indicates the rotation shaft direction of the heating roller 24.

The pressing member 26 (referring to FIG. 2) has a shape long in the front and rear direction. The pressing member 26, for example, is made of metal such as aluminum, SUS, and iron or a heat-resistant resin such as PI (polyimide). Both front and rear end portions of the pressing member 26 are fixed to each upper base plate 34 of the upper frame 32 (referring to FIG. 3). In this way, the pressing member 26 is supported to the upper frame 32.

As illustrated in FIG. 2, the pressing member 26 includes a pressing section 71, a guide section 72 bent upward from a right end portion (an end portion of an upstream side in the sheet conveyance direction) of the pressing section 71, and a bending section 73 bent to the left side (a downstream side in the sheet conveyance direction) from an upper end portion (a side separated from the pressure roller 23) of the guide section 72. A boundary portion between the pressing section 71 and the guide section 72 and a boundary portion between the guide section 72 and the bending section 73 do not have edges and are curved.

The pressing section 71 is disposed to interpose the fixing belt 22 between the pressure roller 23 and the pressing section 71. The pressing section 71 presses down the fixing belt 22 (to the pressure roller 23 side). The pressing section 71 is curved in an arc shape along an outer peripheral surface of the pressure roller 23.

A sheet member (not illustrated) is interposed between the pressing section 71 and the inner peripheral surface of the fixing belt 22. The sheet member, for example, is made of a low friction material such as a glass cloth sheet, and has a coefficient of friction lower than that of the pressing member 26. The surface of the sheet member is subjected to coating by a fluorine resin such as PFA.

The guide section 72 extends linearly along the substantially vertical direction. The guide section 72 contacts with the inner peripheral surface of the fixing belt 22 and slidably supports the fixing belt 22.

The bending section 73 has a length shorter than those of the pressing section 71 and the guide section 72. The bending section 73 is separated from the inner peripheral surface of the fixing belt 22.

The heater 27 has a shape long in the front and rear direction. The heater 27, for example, is comprised of a halogen heater of 800 W. The heater 27 is configured to generate heat by conduction and to radiate radiant heat.

The heater 27 is disposed between the heating roller 24 and the pressing member 26. A lower side (the pressure roller 23 side) of the heater 27 is covered with the pressing section 71 of the pressing member 26. A right side (the upstream side in the sheet conveyance direction) of the heater 27 is covered with the guide section 72 of the pressing member 26. A left side (the downstream side in the sheet conveyance direction) of the heater 27 is covered with the heating roller 24. An upper side of the heater 27 is covered with the heating roller 24 and the pressing member 26.

The heater 27 is disposed at a left side (the downstream side in the sheet conveyance direction) of a vertical line Z passing through a left end portion (an end portion of the downstream side in the sheet conveyance direction) of the bending section 73 of the pressing member 26. As apparent from this configuration, the heater 27 is disposed at a left side (the downstream side in the sheet conveyance direction) of the bending section 73 of the pressing member 26. Both front and rear end portions of the heater 27 are engaged with the support pieces 37 of the upper frame 32 (referring to FIG. 3). In this way, the heater 27 is supported to the upper frame 32.

As illustrated in FIG. 2, a fixing nip 90 is formed at a press-contact portion of the fixing belt 22 and the pressure roller 23. The fixing nip 90 includes a first nip portion 91, a second nip portion 92 formed at a right side of the first nip portion 91, and a third nip portion 93 formed between the first nip portion 91 and the second nip portion 92.

The first nip portion 91 is formed at a part at which the pressure roller 23 and the heating roller 24 interpose the fixing belt 22 therebetween. The first nip portion 91 is backed up from an inner side in the radial direction of the fixing belt 22 by the heating roller 24. A width of the first nip portion 91, for example, is 1.5 mm.

The second nip portion 92 is formed at a part at which the pressure roller 23 and the pressing section 71 of the pressing member 26 interpose the fixing belt 22 therebetween. The second nip portion 92 is backed up from the inner side in the radial direction of the fixing belt 22 by the pressing section 71 of the pressing member 26. The second nip portion 92 is provided on the upstream side of the first nip portion 91 in the rotation direction (referring to the arrow A of FIG. 2) of the fixing belt 22. The sum of force applied to the second nip portion 92 is larger than the sum of force applied to the first nip portion 91. That is, force by which the pressure roller 23 and the pressing section 71 of the pressing member 26 interpose the fixing belt 22 therebetween is larger than force by which the pressure roller 23 and the heating roller 24 interpose the fixing belt 22 therebetween. A width of the second nip portion 92, for example, is 9 mm.

The third nip portion 93 is provided at a position corresponding to a gap 94 formed between the lower end portion of the heating roller 24 and the pressing section 71 of the pressing member 26. Therefore, the third nip portion 93 is not backed up from the inner side in the radial direction of the fixing belt 22. A width of the third nip portion 93, for example, is 1.5 mm.

In the fixing device 18 configured as above, when a toner image is fixed to a sheet, the driving source 52 is driven. As described above, when the driving source 52 is driven, the rotation of the driving source 52 is transferred to the pressure roller 23 via the transmission gear 51, so that the pressure roller 23 is rotated as indicated by an arrow B of FIG. 2. As described above, when the pressure roller 23 is rotated by the driving source 52, the fixing belt 22 is rotated by the rotation of the pressure roller 23 as indicated by the arrow A of FIG. 2. Furthermore, as indicated by an arrow C of FIG. 2, the heating roller 24 is rotated by the rotation of the fixing belt 22. In addition, the fixing belt 22 is rotated toward the heating roller 24 side from the pressing member 26 side in the state in which the fixing belt 22 has been interposed between the pressure roller 23 and the heating roller 24.

Furthermore, when the toner image is fixed to the sheet, the heater 27 is operated (is turned on). As described above, when the heater 27 is operated, radiant heat is radiated from the heater 27. A part of the radiant heat radiated from the heater 27 directly reaches the inner peripheral surface of the fixing belt 22 as indicated by an arrow H1 of FIG. 2. In this way, the fixing belt 22 is directly heated by the radiant heat radiated from the heater 27.

A separate part of the radiant heat radiated from the heater 27 directly reaches the outer peripheral surface of the heating roller 24 as indicated by an arrow H2 of FIG. 2. In this way, the heating roller 24 is directly heated by the radiant heat radiated from the heater 27. Accordingly, the fixing belt 22 is heated by heat transfer from the heating roller 24.

A further separate part of the radiant heat radiated from the heater 27 directly reaches the pressing section 71, the guide section 72, and the bending section 73 of the pressing member 26 as indicated by an arrow H3 of FIG. 2. In this way, the pressing member 26 is directly heated by the radiant heat radiated from the heater 27.

In the state in which the fixing belt 22 has been heated by the heater 27 together with the rotation of the fixing belt and the pressure roller 23 as described above, the sheet passes through the fixing nip 90. In this way, the toner image is heated and pressed and is fixed to the sheet.

In the present embodiment, as described above, the fixing belt 22 is directly heated by the radiant heat radiated from the heater 27. Therefore, as compared with the case in which the fixing belt 22 is heated only by the heat transfer from the heating roller 24, it is possible to shorten a heating-up time of the fixing belt 22, and to reliably fix a toner image to a sheet.

Furthermore, the pressing member 26 is directly heated by the radiant heat radiated from the heater 27. Accordingly, the temperature of the pressing member 26 is not easily reduced, so that it is possible to suppress the heat of the fixing belt 22 from being taken away by the pressing member 26. Therefore, it is possible to further shorten the heating-up time of the fixing belt 22, and to more reliably fix a toner image to a sheet.

Furthermore, the lower side (the pressure roller 23 side) of the heater 27 is covered with the pressing section 71 of the pressing member 26, the right side (the upstream side in the sheet conveyance direction) of the heater 27 is covered with the guide section 72 of the pressing member 26, and the left side (the downstream side in the sheet conveyance direction) of the heater 27 is covered with the heating roller 24. When such a configuration is employed, it is possible to ensure an installation space of the heater 27 by a simple configuration.

Furthermore, the heater 27 is disposed at the left side (the downstream side in the sheet conveyance direction) of the bending section 73 of the pressing member 26. When such a configuration is employed, the radiant heat radiated from the heater 27 directly reach the fixing belt 22 easily. Therefore, it is possible to further shorten the heating-up time of the fixing belt 22, and to more reliably fix a toner image to a sheet. Furthermore, the pressing member 26 has the bending section 73, so that it is possible to prevent the fixing belt from being damaged by the upper end portion of the guide section 72, and to smoothly lead the fixing belt 22 to the guide section 72 side.

Furthermore, in the present embodiment, the coating layer 62 of the heating roller 24 having a coefficient of friction higher than that of the base layer 61 of the heating roller 24 is brought into contact with the inner peripheral surface of the fixing belt 22. When such a configuration is employed, it is possible to strongly grip the fixing belt 22 by the pressure roller 23 and the heating roller 24, and to drag the fixing belt 22 to the left side (the downstream side in the rotation direction of the fixing belt 22) in the first nip portion 91 of the fixing nip 90. Accordingly, the fixing belt is stretched between the first nip portion 91 and the second nip portion 92 of the fixing nip 90, so that it is possible to effectively prevent bending or buckling of the fixing belt 22 and to suppress image degradation.

Furthermore, the guide section 72 of the pressing member 26 contacts with the inner peripheral surface of the fixing belt 22 and slidably supports the fixing belt 22. When such a configuration is employed, it is possible to heat the fixing belt 22 by the heat transfer from the guide section 72 as well as the heat transfer from the pressing section 71 of the pressing member 26, so that it is possible to improve the heating efficiency of the fixing belt 22. Furthermore, it is possible to smoothly lead the fixing belt 22 to the fixing nip 90.

In the present embodiment, the case in which the pressing member 26 and the heater 27 are disposed at the right side (the upstream side in the sheet conveyance direction) of the heating roller 24 has been described. On the other hand, in another embodiment, the pressing member 26 and the heater 27 may also be disposed at the left side (the downstream side in the sheet conveyance direction) of the heating roller 24.

Figure 4:
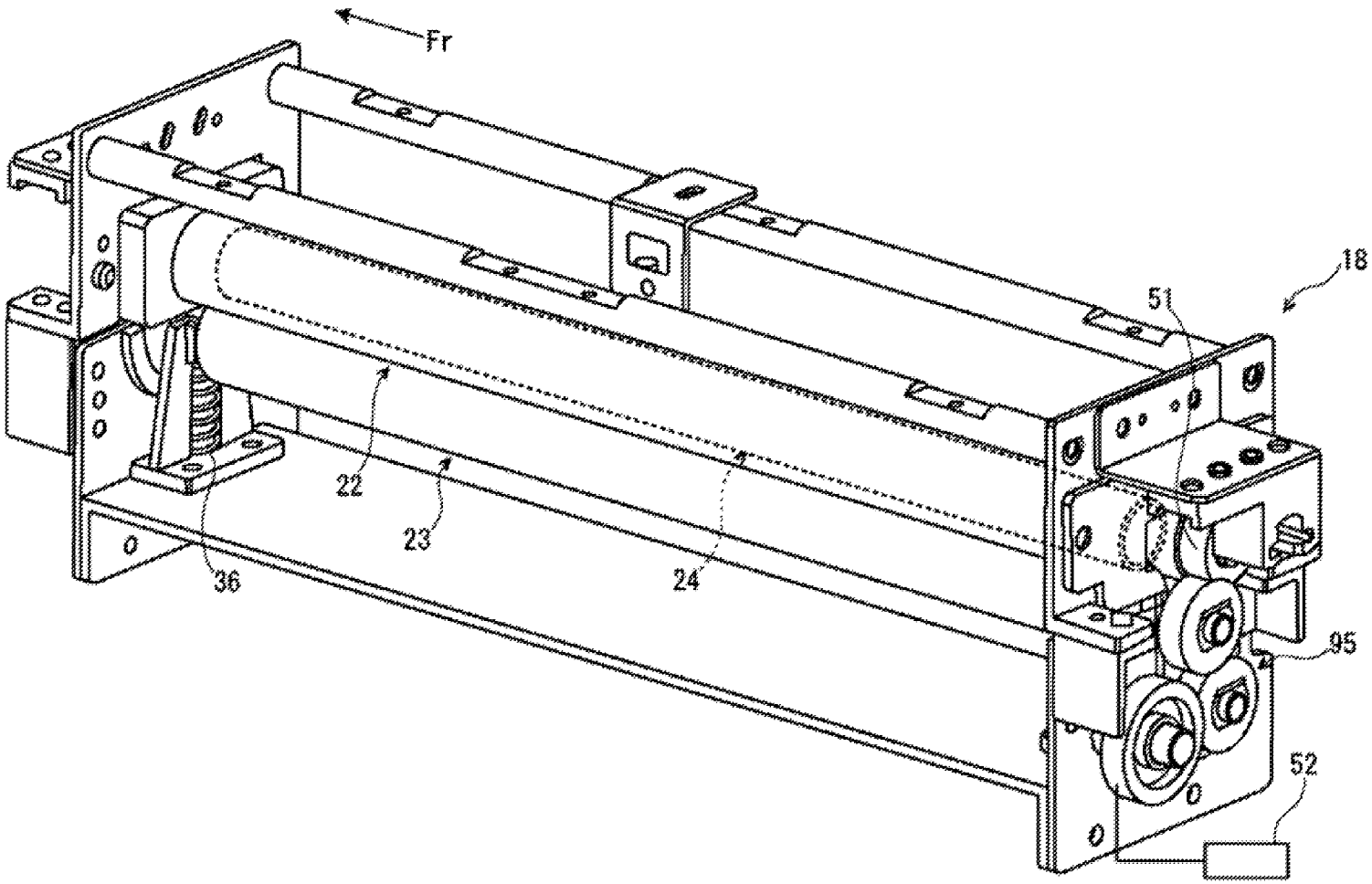
FIG. 4 is a perspective view illustrating a fixing device according to another embodiment.

In the present embodiment, the case in which the transmission gear 51 is fixed to the pressure roller 23 and the driving source 52 is connected to the pressure roller 23 via the transmission gear 51 has been described. On the other hand, in another embodiment, as illustrated in FIG. 4, the transmission gear 51 may also be fixed to the heating roller and the driving source 52 may also be connected to the heating roller 24 via the transmission gear 51 and a gear train 95. In this case, when the heating roller 24 is rotated by the driving source 52, the fixing belt 22 and the pressure roller 23 are rotated by the rotation of the heating roller 24.

In the present embodiment, the case in which the fixing belt 22 is urged to the lower side (the pressure roller 23 side) by the coil springs 36 (the urging members) has been described. On the other hand, in another embodiment, as illustrated in FIG. 4, the pressure roller 23 may also be urged to the upper side (the fixing belt 22 side) by the coil springs 36 (the urging members).

In the present embodiment, the case in which the fixing belt 22 is laid over the heating roller 24 and the pressing member 26 in the state in which the upper portion of the fixing belt 22 is loosened has been described. On the other hand, in another embodiment, the fixing belt 22 may also be laid over the heating roller 24 and the pressing member 26 in the state in which the upper portion of the fixing belt 22 is not loosened.

In the present embodiment, the case in which the base layer of the fixing belt 22 is made of a resin (PI (polyimide)) has been described. On the other hand, in another embodiment, the base layer of the fixing belt 22 may also be made of metal such as SUS and nickel.

In the present embodiment, the case in which the pressure roller 23 includes the core 53 and the elastic layer 54 has been described. On the other hand, in another embodiment, the pressure roller 23 may also include a release layer for covering the elastic layer 54 in addition to the core 53 and the elastic layer 54. The release layer of the pressure roller 23, for example, is made of a PFA tube.

In the present embodiment, the case in which the heater 27 configured by a halogen heater is used as the heat source has been described. However, in another embodiment, a carbon heater, a ceramic heater and the like may also be used as the heat source.

In the present embodiment, the case in which the configuration of the present disclosure is applied to the printer 1 has been described. However, in another embodiment, the configuration of the present disclosure may also be applied to other image forming apparatuses such as a copy machine, a facsimile, and a multifunctional device.

Second Embodiment

Next, a fixing device 100 according to a second embodiment of the present disclosure will be described with reference to FIG. 5 and FIG. 6.

Figure 5:
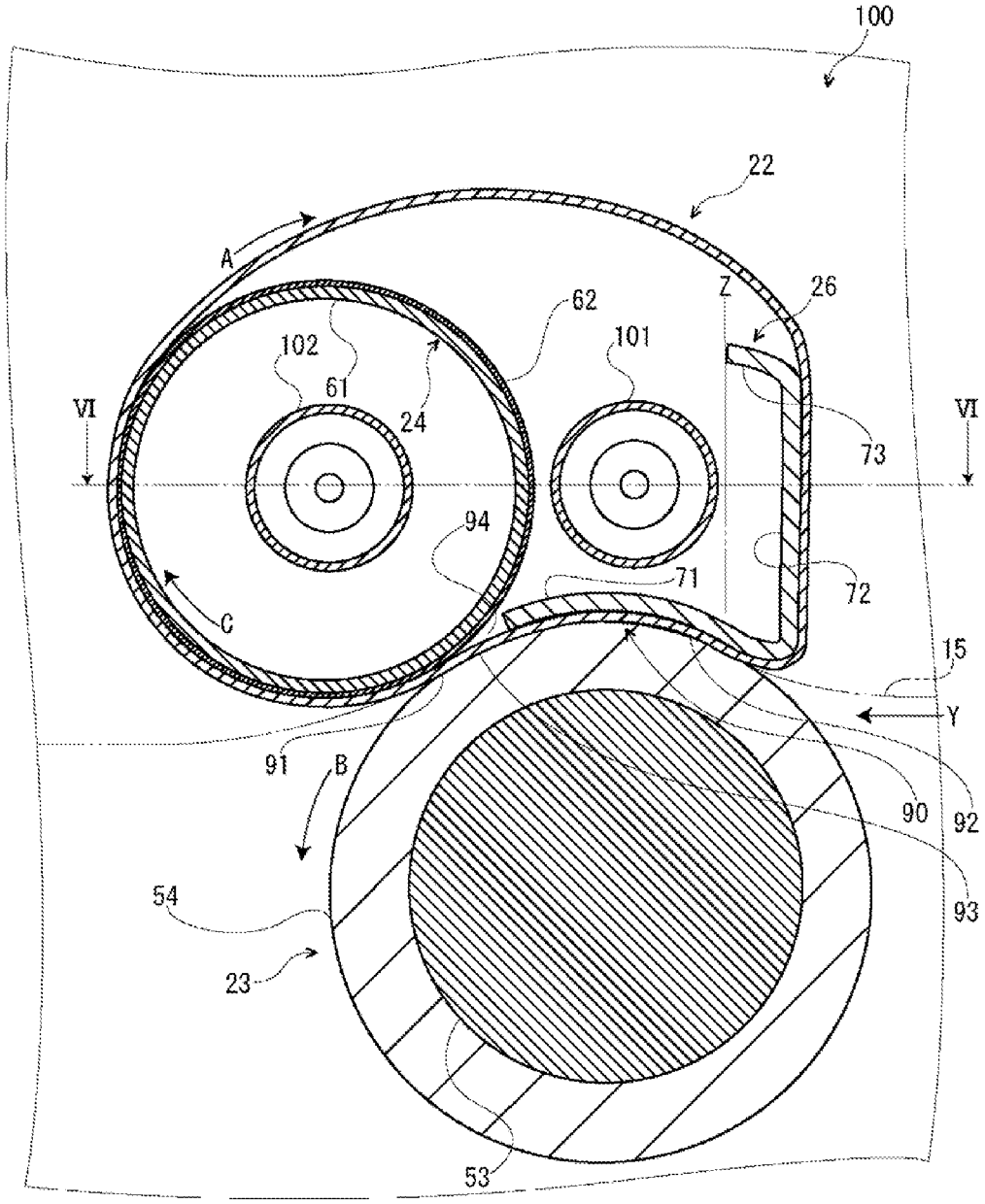
FIG. 5 is a sectional view illustrating a fixing device according to a second embodiment.

As illustrated in FIG. 5, the fixing device 100 includes a fixing frame 21 (not illustrated in FIG. 5), a fixing belt provided in an upper portion of the fixing frame 21, a pressure roller 23 (a pressure member) provided in a lower portion of the fixing frame 21, a heating roller 24 (a heating member) disposed radially inside the fixing belt 22, a pressing member 26 disposed radially inside the fixing belt 22 and at the right side of (radially outside) the heating roller 24, a heater 101 (a heat source) disposed radially inside the fixing belt 22 and at the right side (radially outside) of the heating roller 24 similarly to the pressing member 26, and an auxiliary heater 102 (an auxiliary heat source) disposed radially inside the heating roller 24. In addition, since configurations of the other elements, except for the fixing belt 22, the heater 101, and the auxiliary heater 102, are similar to those of the first embodiment, a description thereof will be omitted.

Figure 6:
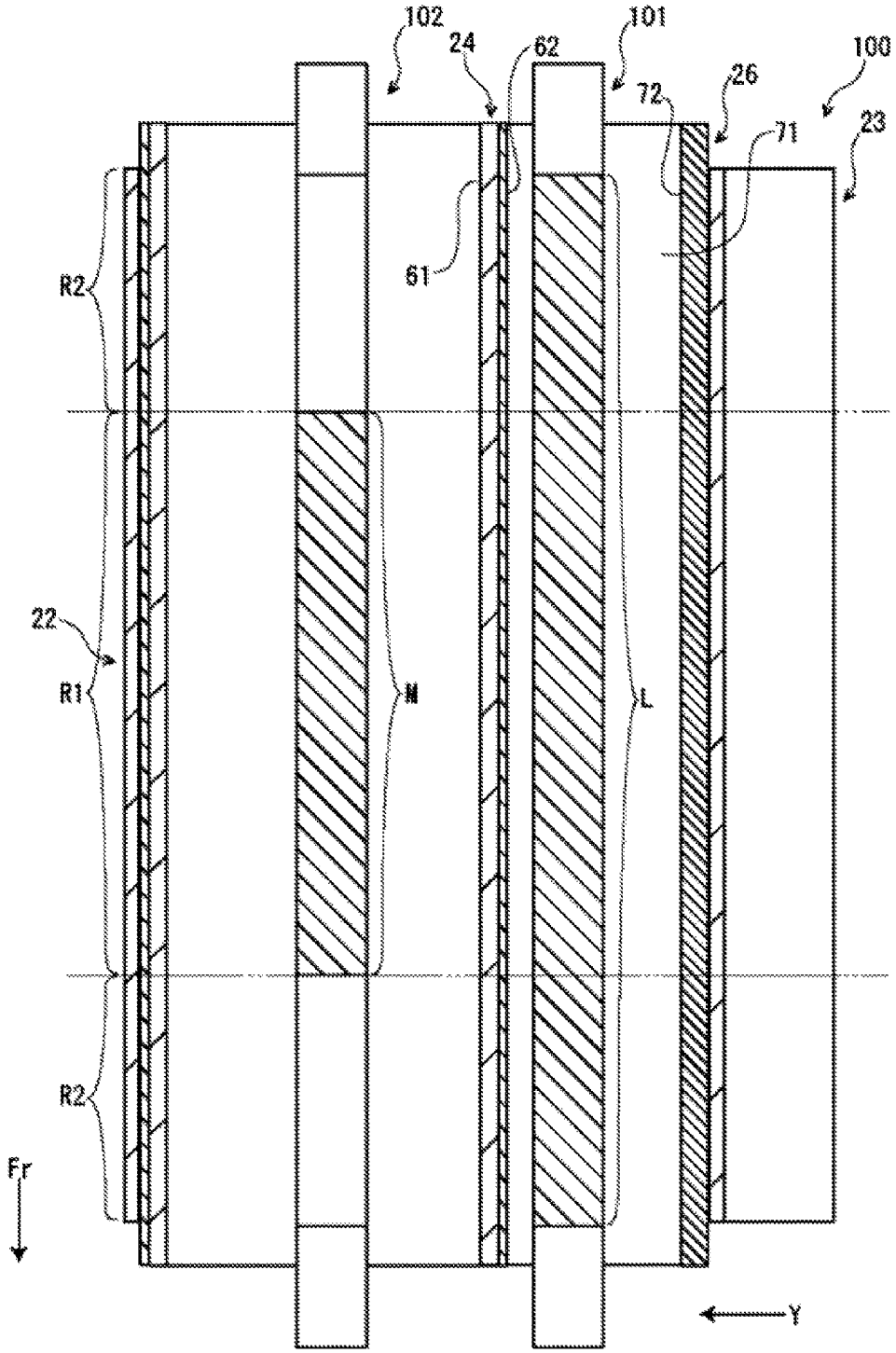
FIG. 6 is a sectional view taken along line VI-VI of FIG. 5.

As illustrated in FIG. 6, the fixing belt 22 has a first sheet passing area R1 and second sheet passing areas R2 provided at both front and rear sides (except for the first sheet passing area R1) of the first sheet passing area R1. The first sheet passing area R1 indicates an area in which a sheet with a first size (for example, a sheet with an A5 size) passes. The second sheet passing area R2 indicates an area in which a sheet with a second size (for example, a sheet with an A4 size) having a width wider than that of the sheet with the first size in the front and rear direction passes. Since other configurations of the fixing belt 22 are similar to those of the first embodiment, a description thereof will be omitted.

The heater 101 has a heating area L. The "heating area" indicates an area having a function of radiating radiant heat. A position of the heating area L of the heater 101 corresponds to positions of the first sheet passing area R1 and the second sheet passing areas R2 of the fixing belt 22 in the front and rear direction. Since other configurations of the heater 101 are similar to those of the "heater 27" of the first embodiment, a description thereof will be omitted.

The auxiliary heater 102 is disposed at a left side (the downstream side in the sheet conveyance direction) of the heater 101. The auxiliary heater 102 has a heating area M. A position of the heating area M of the auxiliary heater 102 corresponds to the position of the first sheet passing area R1 of the fixing belt 22 in the front and rear direction. Since other configurations of the auxiliary heater 102 are similar to those of the heater 101, a description thereof will be omitted.

In the fixing device 100 configured as above, when a toner image is fixed to the sheet with the first size, an operating time of the auxiliary heater 102 is set to be longer than that of the heater 101. For example, when the operating time of the auxiliary heater 102 is set to 1, the operating time of the heater 101 is set to 0.3. Alternatively, when the operating time of the auxiliary heater 102 is set to 1, the operating time of the heater 101 is set to 0. That is, the heater 101 is not operated.

As described above, when the operating time of the auxiliary heater 102 is set to be longer than that of the heater 101, even though the sheet with the first size has captured heat from the first sheet passing area R1, the excessive temperature rise of the second sheet passing areas R2 with respect to the first sheet passing area R1 does not occur easily. Accordingly, it is possible to improve the productivity (the number of fixable sheets per a constant time) when a toner image is fixed to the sheet with the first size.

Furthermore, when the sheet with the first size is a heavy sheet, since the sheet with the first size captures a large amount of heat from the first sheet passing area R1 as compared with the case in which the sheet with the first size is a plain sheet or a thin sheet, the excessive temperature rise of the second sheet passing areas R2 with respect to the first sheet passing area R1 occurs easily. However, when the aforementioned configuration is used, even though the sheet with the first size is a heavy sheet, it is possible to effectively suppress the excessive temperature rise of the second sheet passing areas R2 with respect to the first sheet passing area R1. Therefore, it is possible to improve media adaptability (adaptability to the thickness of a sheet).

On the other hand, in the fixing device 100 configured as above, when a toner image is fixed to the sheet with the second size, an operating time of the heater 101 is set to be longer than that of the auxiliary heater 102. For example, when the operating time of the heater 101 is set to 1, the operating time of the auxiliary heater 102 is set to 0.3. Alternatively, when the operating time of the heater 101 is set to 1, the operating time of the auxiliary heater 102 is set to 0. That is, the auxiliary heater 102 is not operated. In this way, it is possible to reliably fix the toner image to the sheet with the second size.

In the present embodiment, the auxiliary heater 102 disposed radially inside the heating roller 24 is provided separately from the heater 101. Accordingly, it is possible to enhance a function of heating the fixing belt 22 by heat transfer from the heating roller 24. Therefore, it is possible to further shorten the heating-up time of the fixing belt 22, and to more reliably fix a toner image to a sheet.

In the present embodiment, the case, in which the position of the heating area L of the heater 101 corresponds to the positions of the first sheet passing area R1 and the second sheet passing areas R2 of the fixing belt 22 in the front and rear direction, and the position of the heating area M of the auxiliary heater 102 corresponds to the position of the first sheet passing area R1 of the fixing belt 22 in the front and rear direction, has been described. On the other hand, in another embodiment, the position of the heating area L of the heater 101 may also correspond to the position of the first sheet passing area R1 of the fixing belt 22 in the front and rear direction, and the position of the heating area M of the auxiliary heater 102 may also correspond to the positions of the first sheet passing area R1 and the second sheet passing areas R2 of the fixing belt 22 in the front and rear direction.

In the present embodiment, the case, in which the position of the heating area L of the heater 101 corresponds to the positions of the first sheet passing area R1 and the second sheet passing areas R2 of the fixing belt 22 in the front and rear direction, and the position of the heating area M of the auxiliary heater 102 corresponds to the position of the first sheet passing area R1 of the fixing belt 22 in the front and rear direction, has been described. On the other hand, in another embodiment, as illustrated in FIG. 7, the position of the heating area L of the heater 101 may also correspond to the positions of the second sheet passing areas R2 of the fixing belt 22 in the front and rear direction, and the position of the heating area M of the auxiliary heater 102 may also correspond to the position of the first sheet passing area R1 of the fixing belt 22 in the front and rear direction.

In the case of employing such a configuration, when a toner image is fixed to the sheet with the first size, the auxiliary heater 102 is operated. In this way, similarly to the present embodiment, it is possible to suppress the excessive temperature rise of the second sheet passing areas R2 with respect to the first sheet passing area R1. Accordingly, it is possible to improve the productivity (the number of fixable sheets per a constant time) when a toner image is fixed to the sheet with the first size. On the other hand, when a toner image is fixed to the sheet with the second size, both the heater 101 and the auxiliary heater 102 are operated. In this way, it is possible to reliably fix a toner image to the sheet with the second size.

Figure 7:
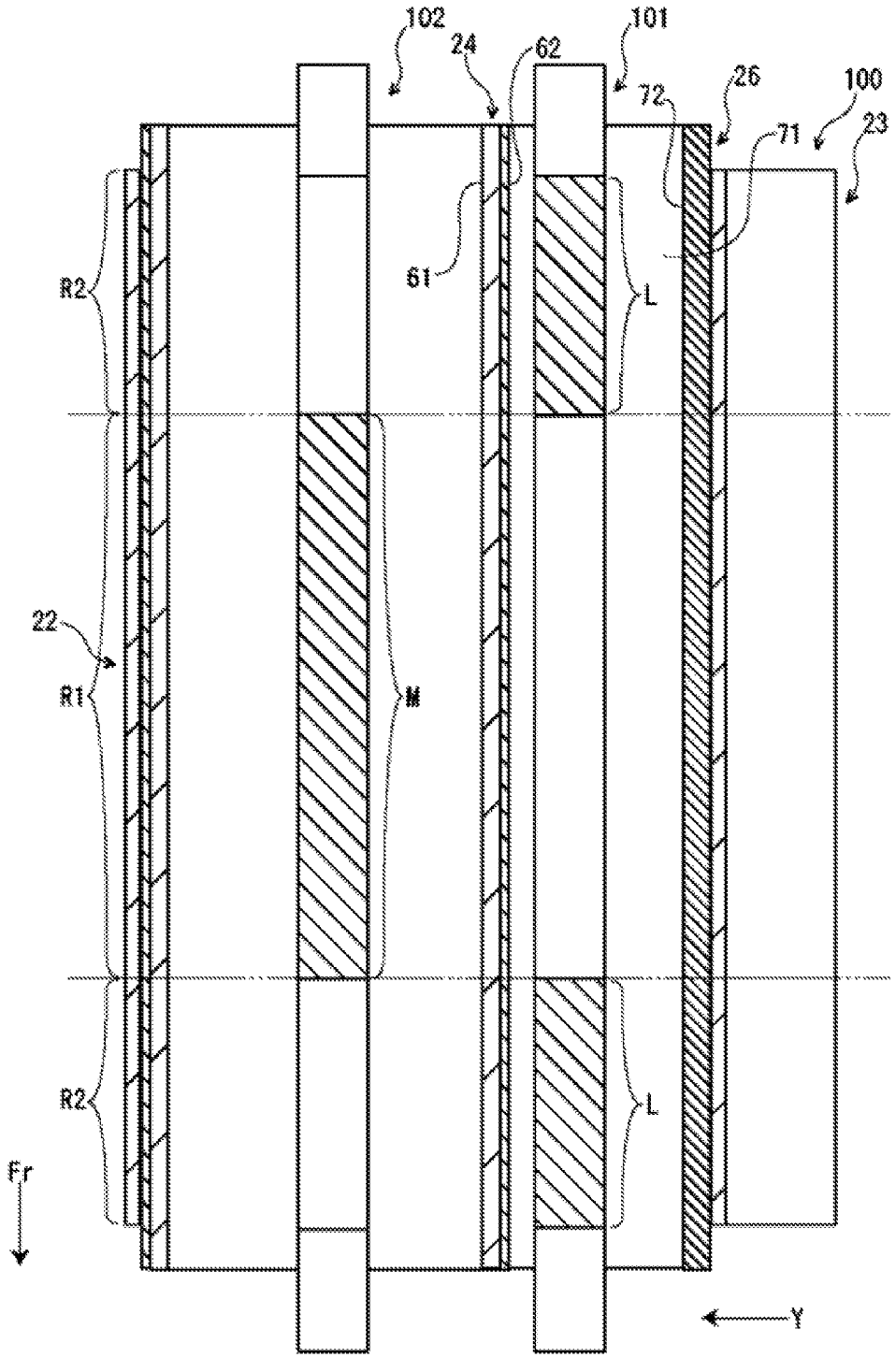
FIG. 7 is a sectional view illustrating a fixing device according to another embodiment.

In addition, in FIG. 7, the position of the heating area L of the heater 101 corresponds to the positions of the second sheet passing areas R2 of the fixing belt 22 in the front and rear direction, and the position of the heating area M of the auxiliary heater 102 corresponds to the position of the first sheet passing area R1 of the fixing belt 22 in the front and rear direction. On the other hand, in further another embodiment, the position of the heating area L of the heater 101 may also correspond to the position of the first sheet passing area R1 of the fixing belt 22 in the front and rear direction, and the position of the heating area M of the auxiliary heater 102 may also correspond to the positions of the second sheet passing areas R2 of the fixing belt 22 in the front and rear direction.

What is claimed is:

1. A fixing device comprising:

a fixing belt rotatably provided;

a pressure member brought into press-contact with the fixing belt to form a fixing nip and rotatably provided;

a heating member disposed to interpose the fixing belt between the pressure member and the heating member and rotatably provided;

a pressing member disposed to interpose the fixing belt between the pressure member and the pressing member and pressing the fixing belt toward a side of the pressure member; and a heat source disposed radially inside the fixing belt and radially outside the heating member, wherein radiant heat radiated from the heat source directly reaches the fixing belt, the heating member, and the pressing member.

2. The fixing device of claim 1, further comprising:

an auxiliary heat source disposed radially inside the heating member.

3. The fixing device of claim 2, wherein the fixing belt comprises:

a first sheet passing area through which a recording medium with a first size passes; and a second sheet passing area provided outside the first sheet passing area and through which a recording medium with a second size having a width wider than a width of the recording medium with the first size passes, wherein one of the heat source and the auxiliary heat source has a heating area corresponding to the first sheet passing area, and a remaining one of the heat source and the auxiliary heat source has a heating area corresponding to the first sheet passing area and the second sheet passing area, wherein, when a toner image is fixed to the recording medium with the first size, an operating time of the one of the heat source and the auxiliary heat source is set to be longer than an operating time of the remaining one of the heat source and the auxiliary heat source, and when a toner image is fixed to the recording medium with the second size, the operating time of the remaining one of the heat source and the auxiliary heat source is set to be longer than the operating time of the one of the heat source and the auxiliary heat source.

4. The fixing device of claim 2, wherein the fixing belt comprises:

a first sheet passing area through which a recording medium with a first size passes; and a second sheet passing area provided outside the first sheet passing area and through which a recording medium with a second size having a width wider than a width of the recording medium with the first size passes, wherein one of the heat source and the auxiliary heat source has a heating area corresponding to the first sheet passing area, and a remaining one of the heat source and the auxiliary heat source has a heating area corresponding to the second sheet passing area, wherein, when a toner image is fixed to the recording medium with the first size, the one of the heat source and the auxiliary heat source is operated, and when a toner image is fixed to the recording medium with the second size, both the heat source and the auxiliary heat source are operated.

5. The fixing device of claim 1, wherein the pressing member comprises:

a pressing section pressing the fixing belt toward the side of the pressure member;

a guide section bent toward a side separated from the pressure member from an end portion of an upstream side of the pressing section in a conveyance direction of a recording medium, wherein the side of the pressure member of the heat source is covered with the pressing section, an upstream side of the heat source in the conveyance direction of the recording medium is covered with the guide section, and a downstream side of the heat source in the conveyance direction of the recording medium is covered with the heating member.

6. The fixing device of claim 5, wherein the pressing member further comprises:

a bending section bent toward a downstream side in the conveyance direction of the recording medium from an end portion of the side of the guide section separated from the pressure member, wherein the heat source is disposed at a downstream side of the bending section in the conveyance direction of the recording medium.

7. The fixing device of claim 5, wherein the guide section contacts with an inner peripheral surface of the fixing belt and slidably supports the fixing belt.

8. An image forming apparatus including the fixing device of claim 1.

* * * * *